US010480228B2

(12) United States Patent
Kim et al.

(10) Patent No.: US 10,480,228 B2
(45) Date of Patent: Nov. 19, 2019

(54) HINGE SUPPORTING APPARATUS FOR DOOR OF REFRIGERATOR

(71) Applicant: Samsung Electronics Co., Ltd., Suwon-si (KR)

(72) Inventors: Jin-ho Kim, Damyang-gun (KR); Cheon-seok Ko, Gwangju (KR); Sung-cheul Park, Gwangju (KR)

(73) Assignee: SAMSUNG ELECTRONICS CO., LTD., Suwon, Si (KR)

( * ) Notice: Subject to any disclaimer, the term of this patent is extended or adjusted under 35 U.S.C. 154(b) by 96 days.

(21) Appl. No.: 15/354,438

(22) Filed: Nov. 17, 2016

(65) Prior Publication Data

US 2017/0138104 A1 May 18, 2017

(30) Foreign Application Priority Data

Nov. 18, 2015 (KR) ..... 10-2015-0161804

(51) Int. Cl.
*E05D 7/04* (2006.01)

(52) U.S. Cl.
CPC .... *E05D 7/0415* (2013.01); *E05D 2007/0484* (2013.01); *E05Y 2900/31* (2013.01); *F25D 2323/024* (2013.01)

(58) Field of Classification Search
CPC ..... E05D 7/04; E05D 7/0415; E05D 7/0423; E05D 2007/0484; F25D 2323/024
USPC ..... 16/235, 242
See application file for complete search history.

(56) References Cited

U.S. PATENT DOCUMENTS 5,781,966 A * 7/1998 Ferrari ..... E05D 7/0407 16/242
5,788,351 A * 8/1998 Prunty ..... A47L 15/4261 16/235
5,960,518 A * 10/1999 Jeong ..... E05D 7/123 16/257
6,682,250 B2 * 1/2004 Banks ..... F16B 5/0225 403/374.1
7,350,272 B2 * 4/2008 Fries ..... E05D 7/02 16/236
7,509,708 B1 * 3/2009 Radke ..... E05D 7/0415 16/237
7,516,517 B2 * 4/2009 Fries ..... E05D 7/02 16/236

(Continued)

FOREIGN PATENT DOCUMENTS

EP 2725175 A2 4/2014
KR 1999-0063575 7/1999

(Continued)

OTHER PUBLICATIONS

Extended European Search Report dated May 4, 2017 in corresponding European Patent Application No. 16195908.5.

(Continued)

*Primary Examiner* — Jeffrey O'Brien
(74) *Attorney, Agent, or Firm* — Staas & Halsey LLP

(57) ABSTRACT

A hinge supporting apparatus is provided, which includes a connection member configured to hinge-connect a door to a main body, a cam member configured to vary an installation position of the connection member in order to control a gap between the main body and the door, and a fixing member configured to fix the connection member to the main body.

17 Claims, 11 Drawing Sheets

(56) References Cited

U.S. PATENT DOCUMENTS

| | | | | |
|---|---|---|---|---|
| 7,571,516 | B2 * | 8/2009 | Lueffe | E05D 7/0423 16/235 |
| 7,617,567 | B2 * | 11/2009 | Franchini | E05D 7/04 16/236 |
| 7,748,081 | B2 * | 7/2010 | Ganter | E05D 7/04 16/235 |
| 8,079,114 | B2 * | 12/2011 | Fries | E05D 7/02 16/235 |
| 8,506,026 | B2 * | 8/2013 | Kim | F25D 23/028 312/405 |
| 8,555,464 | B2 * | 10/2013 | Bannon | E05D 7/0415 16/237 |
| 8,720,008 | B2 * | 5/2014 | Dodge | E05D 7/0423 16/245 |
| 9,383,135 | B2 * | 7/2016 | Park | E05D 7/0027 |
| 9,416,573 | B2 * | 8/2016 | Sabrowski | E05D 7/0415 |
| 2002/0073509 | A1 * | 6/2002 | Dean | E05D 7/0415 16/387 |
| 2004/0237257 | A1 | 12/2004 | Pohl | |
| 2008/0074019 | A1 * | 3/2008 | Park | F25D 23/028 312/236 |
| 2012/0032572 | A1 | 2/2012 | Lee | |
| 2012/0037642 | A1 * | 2/2012 | Sun | E05D 7/0027 220/592.02 |
| 2016/0153221 | A1 * | 6/2016 | Dodge | E05D 7/0415 16/238 |
| 2017/0146282 | A1 * | 5/2017 | Dodge | F25D 23/028 |

FOREIGN PATENT DOCUMENTS

| | | |
|---|---|---|
| KR | 2000-0016071 | 8/2000 |
| KR | 10-2008-0066448 | 7/2008 |
| KR | 10-1263434 | 5/2013 |

OTHER PUBLICATIONS

European Office Action dated May 6, 2019 from European Patent Application No. 16195908.5, 6 pages.

* cited by examiner

HINGE SUPPORTING APPARATUS FOR DOOR OF REFRIGERATOR

CROSS-REFERENCE TO RELATED APPLICATIONS

This application claims priority from Korean Patent Application No. 10-2015-0161804 filed on Nov. 18, 2015 in the Korean Intellectual Property Office, the disclosure of which is incorporated herein by reference in its entirety.

BACKGROUND OF THE INVENTION

Field of the Invention

The present disclosure relates to a hinge supporting apparatus for a door of a refrigerator, and more particularly, to a hinge supporting apparatus for a door of a refrigerator, which can control a gap between a main body and the door of the refrigerator.

Description of the Related Art

In general, a refrigerator includes a main body which is provided substantially in the shape of a cuboidal box that forms an exterior of the refrigerator, and a freezing chamber and a refrigerating chamber are partitioned in the main body. Front sides of the freezing chamber and the refrigerating chamber are opened, and doors are hinge-connected to upper and lower portions of the main body to be opened or closed.

The above-described refrigerator in the related art is provided with a hinge supporting apparatus for hinge-connecting the door to the main body. The hinge supporting apparatus has one side that is fixed to the main body through a plurality of fastening screws or clamps and the other side that is rotatably connected to a hinge shaft coupled to the door.

However, the hinge supporting apparatus provided in the refrigerator in the related art does not have a function that can vary the gap between the main body and the door. Accordingly, the refrigerator in the related art has the problem that if the gap between the main body and the door is set to be narrower than a predetermined gap, the door is not closed well or noise occurs when the door is opened and closed. In contrast, the refrigerator in the related art also has the problem that if the gap between the main body and the door is set to be larger than the predetermined gap, the main body and the door are unable to keep airtight, and thus the air outside may flow in between the main body and the door. This may cause performance deterioration of the refrigerator and an abrupt increase of energy consumption.

SUMMARY OF THE INVENTION

Exemplary embodiments of the present disclosure overcome the above disadvantages and other disadvantages not described above, and provide a hinge supporting apparatus for a door of a refrigerator, which can easily control a gap between a main body and the door of the refrigerator with a simple structure.

According to an aspect of the present disclosure, a hinge supporting apparatus includes a connection member configured to hinge-connect a door to a main body; a cam member configured to vary an installation position of the connection member in order to control a gap between the main body and the door; and a fixing member configured to fix the connection member to the main body.

The cam member may be set to have at least one posture with respect to the main body, and through the set posture, the cam member may move the connection member in any one of a first direction in which the connection member moves from the main body toward the door and a second direction in which the connection member moves opposite to the first direction.

The connection member may have an insertion hole which is formed thereon and into which the cam member is inserted, and the insertion hole may include a first end portion that corresponds to one side surface of the cam member and a second end portion which corresponds to the other side surface of the cam member that forms a pair with the one side surface of the cam member.

The first and second end portions may be arranged in parallel and may be spaced apart from each other in a direction in which the door goes away from or approaches the main body.

The cam member may include at least two pairs of side surfaces that form pairs, and the side surfaces of any one of the at least two pairs of side surfaces may be arranged at equal distances from one portion of the cam member, and the side surfaces of the other of the at least two pairs of side surfaces may be arranged at different distances from the one portion of the cam member.

The fastening member may be penetratingly coupled to the one portion of the cam member, and may fix the cam member to the main body.

The main body may have a fastening hole which is formed thereon and to which the fastening member is fastened and a plurality of setting holes which are formed thereon in a circumferential direction around the fastening hole, and the cam member may include a setting projection that is inserted into at least one of the plurality of setting holes.

The number of the plurality of setting holes may be equal to or smaller than the number of side surfaces of the cam member by one.

The main body may have a fastening hole which is formed thereon and to which the fastening member is fastened and at least one setting projection that is adjacent to the fastening hole, and the cam member may include a plurality of setting holes into which the at least one setting projection is inserted.

The cam member may include a plurality of indicating portions that correspond to postures of the cam member.

The plurality of indicating portions may be formed in positions that correspond to the respective side surfaces of the cam member on the cam member.

The fixing member may include a bracket that is fixed to the main body; and a pressing lever having one side that is rotatably connected to the bracket so as to clamp the connection member on the main body or to release clamping.

The fixing member may be a plurality of fastening screws configured to separably fasten the connection member to the main body.

According to another aspect of the present disclosure, a hinge supporting apparatus includes a connection member having one side portion that is variably fixed to a main body of a refrigerator and the other side portion that is hinge-connected to a door of the refrigerator; and a cam member configured to be inserted into the one side portion of the connection member to control a gap between the main body and the door in accordance with variation of an installation position of the connection member.

The cam member may have a plurality of side surfaces which are even-numbered to form pairs with the side surfaces that are arranged in opposite directions to each other, the connection member may have an insertion hole which is formed on the one side portion of the connection member and into which the cam member is inserted, and the insertion hole may include a pair of end portions that correspond to the side surfaces of one of the pairs of the cam member.

The side surfaces that form the pairs of the cam member may be arranged in parallel.

The cam member may have a through-hole to which a fastening member that is separably fixed to the main body is penetratingly coupled, and any one of the side surfaces that form the pairs of the cam member may be arranged at equal distances from the through-hole, and the side surfaces that form the remaining pairs may be arranged at different distances from the through-hole.

The cam member may further include at least one setting projection for maintaining the cam member in any one of predetermined postures and a plurality of setting holes into which the at least one setting projection is inserted.

The setting projection may be formed on any one of the cam member and the main body, and the plurality of setting holes may be formed on the remaining one of the cam member and the main body.

The apparatus may further include a fixing member configured to fix the connection member to the main body in order to maintain an installation position of the connection member.

Additional and/or other aspects and advantages of the disclosure will be set forth in part in the description which follows and, in part, will be obvious from the description, or may be learned by practice of the disclosure.

BRIEF DESCRIPTION OF THE DRAWING FIGURES

The above and/or other aspects of the present disclosure will be more apparent by describing certain exemplary embodiments of the present disclosure with reference to the accompanying drawings, in which.

DETAILED DESCRIPTION OF THE EXEMPLARY EMBODIMENTS

Figure 1:
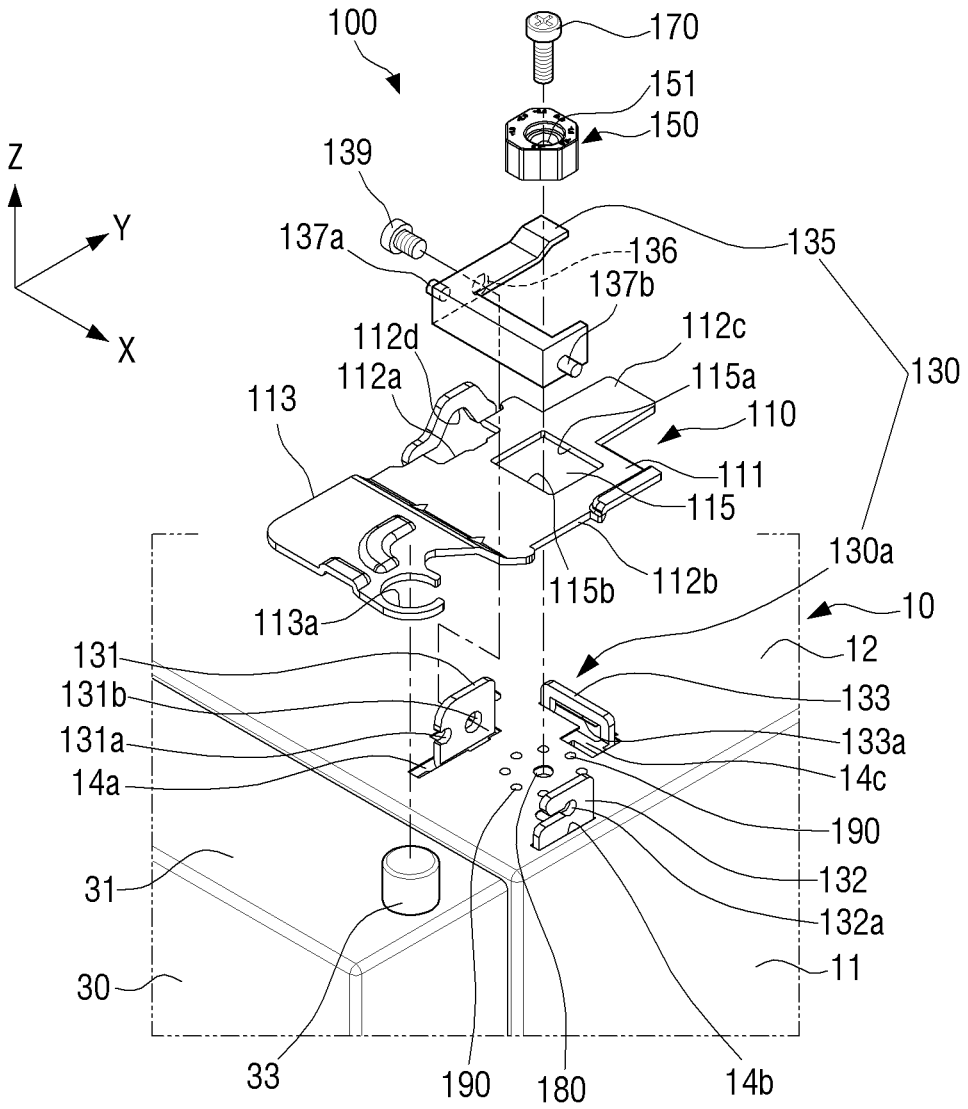
FIG. 1 is an exploded perspective view illustrating a hinge supporting apparatus for a refrigerator door according to an exemplary embodiment of the present disclosure.

Hereinafter, various exemplary embodiments of the present disclosure will be described with reference to the accompanying drawings. However, it should be understood that the present disclosure is not limited to the specific embodiments described hereinafter, but includes various modifications, equivalents, and/or alternatives of the embodiments of the present disclosure. In relation to explanation of the drawings, similar drawing reference numerals may be used for similar constituent elements.

In the description, the terms "first, second, and so forth" are used to describe diverse elements regardless of their order and/or importance and to discriminate one element from other elements, but are not limited to the corresponding elements. For example, a first user appliance and a second user appliance may indicate different user appliances regardless of their order or importance. For example, without departing from the scope of the present disclosure, the first element may be called the second element, and the second element may be called the first element in a similar manner.

The terms used in the description are used to merely describe a specific embodiment, but may not intend to limit the scope of other embodiments. A singular expression may include a plural expression unless specially described. All terms (including technical and scientific terms) used in the description could be used as meanings commonly understood by those ordinary skilled in the art to which the present disclosure belongs. The terms that are used in the present disclosure and are defined in a general dictionary may be used as meanings that are identical or similar to the meanings of the terms from the context of the related art, and they are not interpreted ideally or excessively unless they have been clearly and specially defined. According to circumstances, even the wordings that are defined in the present disclosure are not interpreted to exclude the embodiments of the present disclosure.

A hinge supporting apparatus disclosed in this document is exemplified to be applied to a refrigerator, but is not limited thereto. The hinge supporting apparatus can be applied to any case where it is required to vary a gap between a door and a specific structure on which the door is installed.

Figure 2:
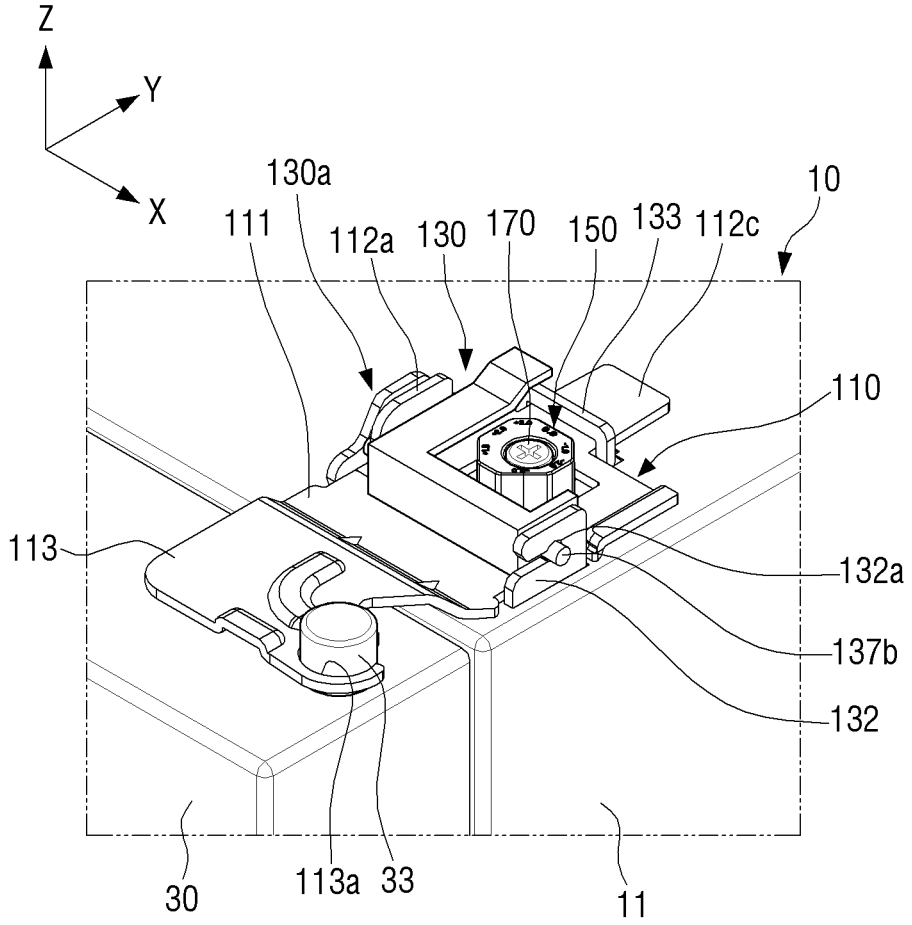
FIG. 2 is a perspective view illustrating a coupling state of a hinge supporting apparatus for a refrigerator door according to an exemplary embodiment of the present disclosure.

FIGS. 1 and 2 are an exploded perspective view and an assembled perspective view illustrating a hinge supporting apparatus for a refrigerator door according to an exemplary embodiment of the present disclosure, Hereinafter, referring to FIGS. 1 and 2, a hinge supporting apparatus 100 according to an embodiment of the present disclosure connects a door 30 of a refrigerator 10 to a main body 11 of the refrigerator 10. In this case, upper and lower ends of one side of the door 30 are pivotally supported by an upper hinge structure and a lower hinge structure that are respectively installed on the main body 11. Although it is described that the hinge supporting apparatus 100 according to an embodiment of the present disclosure corresponds to the upper hinge structure, the hinge supporting apparatus 100 is not limited thereto, but may also be applied to the lower hinge structure.

The hinge supporting apparatus 100 according to an embodiment of the present disclosure may include a connection member 110, a fixing member 130, a cam member 150, and a fastening member 170.

Referring to FIG. 1, the connection member 110 is configured to connect the door 30 to the main body 11 in a manner that one side portion 111 of the connection member 110 is fixed to a part of an upper surface 12, and the other side portion 113 of the connection member 110 is pivotally connected to a hinge shaft 33 that is coupled to an upper surface 31 of the door 30.

Figure 7:
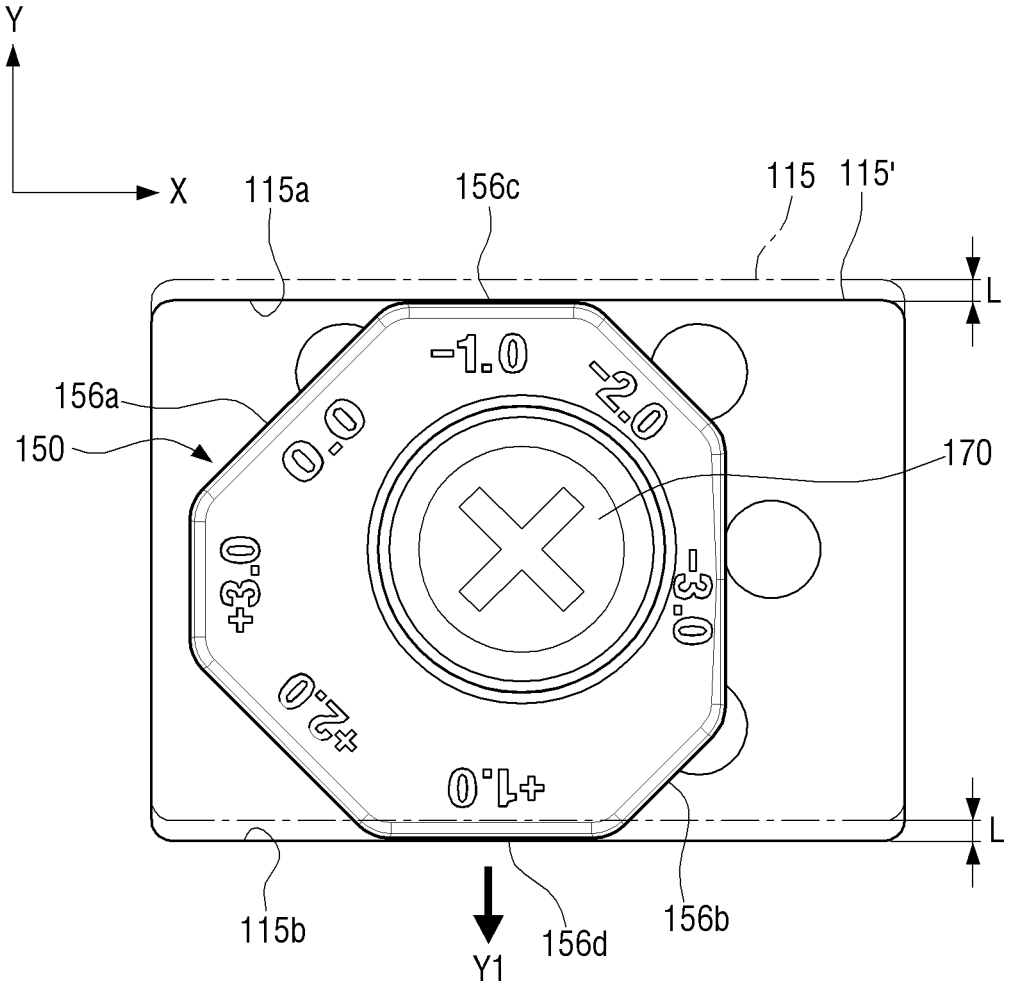
FIG. 7 is a schematic view illustrating a state where the posture of a cam member is set so that a connection member moves in a direction of an arrow Y1.
Figure 8:
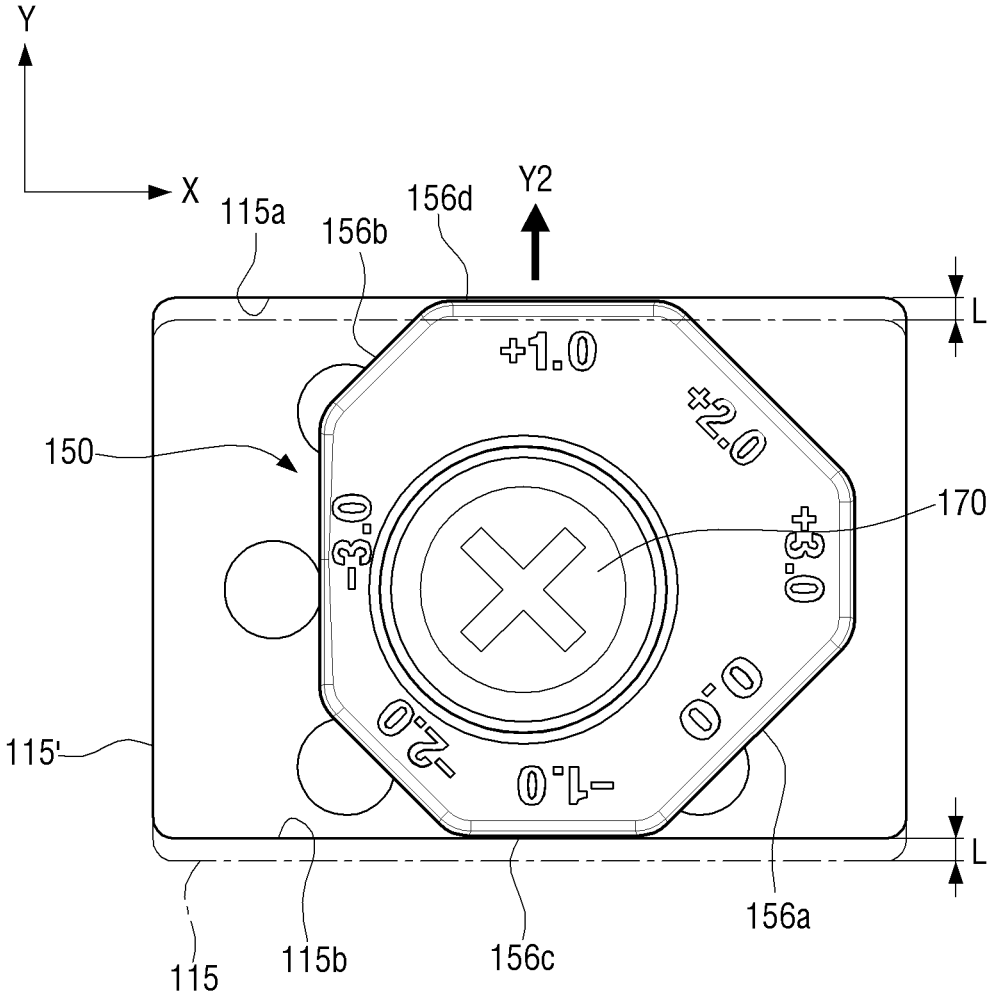
FIG. 8 is a schematic view illustrating a state where the posture of a cam member is set so that a connection member moves in a direction of an arrow Y2.

The one side portion 111 of the connection member 110 is fixed to the upper surface 12 of the main body 11 by the fixing member 130 that is installed on the main body 11. The position in which the other side portion 113 of the connection member 110 is fixed to the upper surface 12 of the main body 11 may be varied in accordance with the setting of the cam member 150, and thus the installation position of the connection member 110 may also be varied. As the installation position of the connection member 110 is varied as described above, a gap between the main body 11 and the door 30 is also varied. That is, if the installation position of the connection member 110 moves in a direction of an arrow Y1 as shown in FIG. 7, the door 30 moves toward the main body 11 to narrow the gap between the main body 11 and the door 30, whereas if the installation position of the connection member 110 moves in a direction of an arrow Y2 as shown in FIG. 8, which is opposite to the first direction, the door 30 goes away from the main body 11 to widen the gap between the main body 11 and the door 30.

Figure 3:
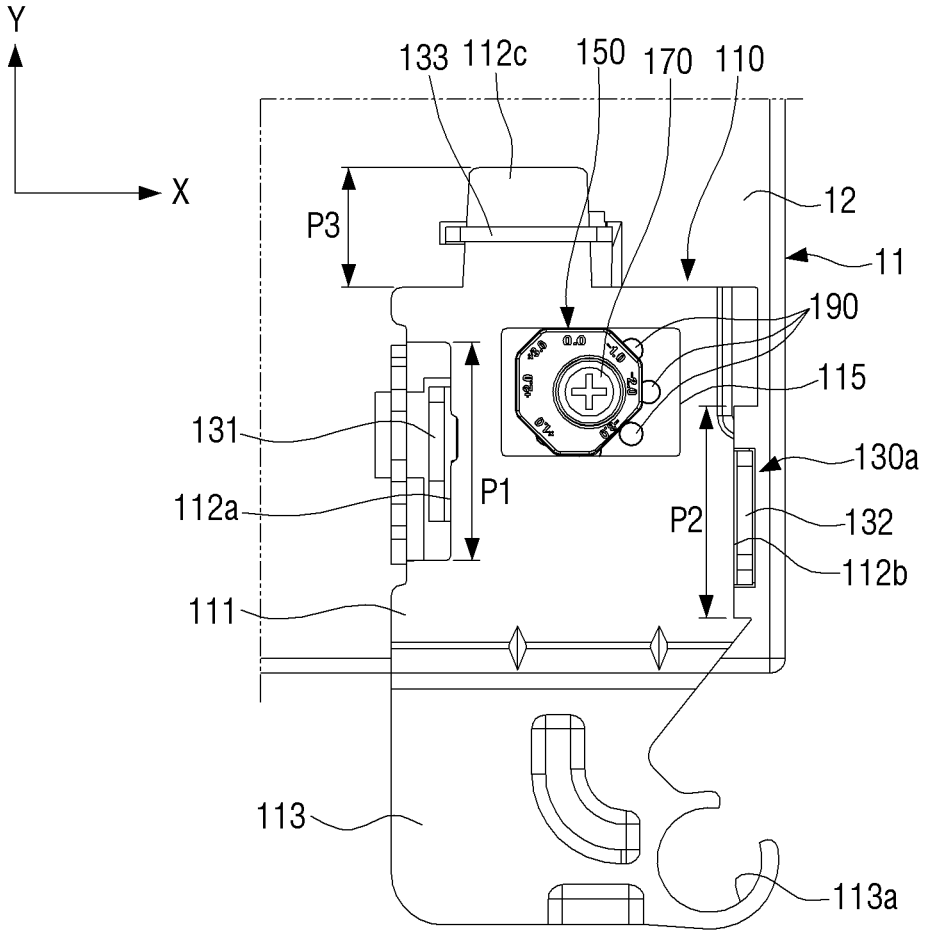
FIG. 3 is a plan view illustrating a hinge supporting apparatus for a refrigerator door in a state where a clamp is removed according to an exemplary embodiment of the present disclosure.

FIG. 3 is a plan view illustrating a hinge supporting apparatus for a refrigerator door in a state where a pressing lever is removed according to an exemplary embodiment of the present disclosure.

Referring to FIG. 3, first and second through-grooves 112*a* and 112*b* are formed at both side ends (X-axis direction) of the connection member 110. The first through-groove 112*a* is penetrated by a first support portion 131 of a bracket 130*a*, and the second through-groove 112*b* is penetrated by a second support portion 132 of the bracket 130*a*. In this case, it is preferable that the first and second through-grooves 112*a* and 112*b* have predetermined lengths P1 and P2 so that they do not interfere with the first and second support portions 131 and 132 of the bracket 130*a* when the connection member 110 moves along the Y-axis direction to change the installation position thereof. An extending locking portion 112*c* is formed at the rear end of the connection member 110. As the locking portion 112*c* is inserted into a fixing portion 133 of the bracket 130*a*, it may be fixed to be prevented from moving in Z-axis direction and in X-axis direction. In this case, it is preferable that the locking portion 112*c* has a predetermined length P3 so that it does not interfere with the fixing portion 133 when the connection member 110 moves along the Y-axis direction to set the installation position thereof.

Figure 6:
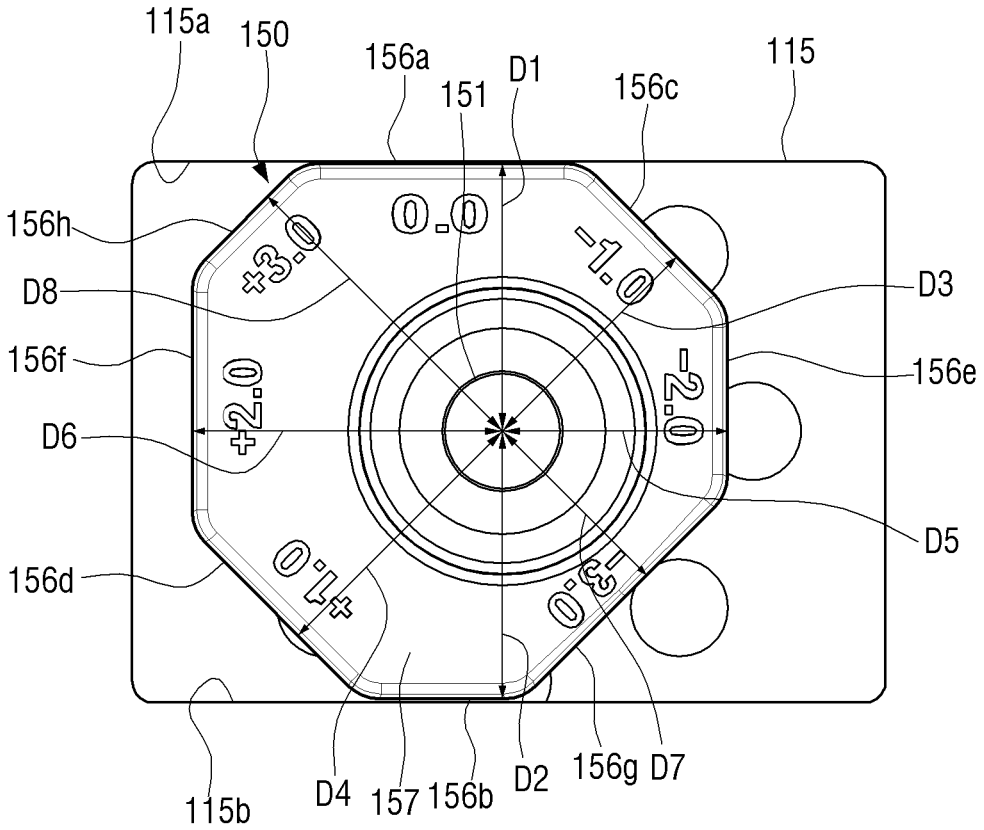
FIG. 6 is a schematic view illustrating a state where a cam member is inserted into an insertion groove of a connection member.

The connection member 110 has an insertion hole 115 which is formed thereon and into which the cam member 150 is inserted. The insertion hole 115 may be substantially in a rectangular shape, and first and second end portions 115*a* and 115*b* that face each other in the Y-axis direction may be arranged in parallel. The first and second end portions 115*a* and 115*b* are set to have a gap (e.g., a gap that corresponds to a sum of lengths (D1+D2) as illustrated in FIG. 6) that corresponds to a gap between a pair of side surfaces that correspond to each other among a plurality of side surfaces of the cam member 150.

Referring to FIG. 1, the fixing member 130 may clamp the one side portion of the connection member 110 so as to stably fix the one side portion of the connection member 110 onto the upper surface 12 of the main body 11, and if the installation position of the connection member 110 is changed, the fixing member 130 may release the clamping.

The fixing member 130 may include a bracket 130*a* that is arranged on a portion of an inside of the main body 11 that corresponds to the upper surface 12 of the main body 11, and a pressing lever 135 to which one side of the bracket 130*a* is rotatably coupled.

The bracket 130*a* includes the first support portion 131, the second support portion 132, and the fixing portion 133, which project at predetermined heights from the upper surface 12 through first to third through-holes 14*a*, 14*b*, and 14*c* that are formed from the inside of the main body 11 to the upper surface 12 of the main body 11. The first and second support portions 131 and 132 are arranged in places that substantially face each other in the X-axis direction, and have first and second coupling grooves 131*a* and 132*a* which are formed thereon and to which a pair of hinge projections 137*a* and 137*b* of the pressing lever 135 are rotatably coupled. The first support portion 131 has a fastening hole 131*b* which is formed thereon and to which a fastening screw 139 for maintaining a posture for clamping the connection member 110 is fastened through rotation of the pressing lever 135 toward the connection member 110. In this case, the fastening screw 139 is penetratingly coupled to a fastening hole 136 of the pressing lever 135 and the fastening hole 131*b* of the first support portion 131 at the same time. The fixing portion 133 has a predetermined space portion 133*a* formed thereon so that the locking portion 112*c* of the connection member 110 can be separably inserted into the space portion 133*a*.

The pressing lever 135 is rotated in one direction (i.e., direction that gets closer to the connection member 110) around the pair of hinge projections 137*a* and 137*b* to clamp the connection member 110 on the upper surface 12 of the main body 11. If the installation position of the connection member 110 is changed, the pressing lever 135 is rotated in an opposite direction (i.e., direction that goes away from the connection member 110) around the pair of hinge projections 137*a* and 137*b* to release the clamping of the connection member 110. When clamping the connection member 110, the pressing lever 135 may be substantially in an "L" shape so as not to interfere with the cam member 150 as shown in FIG. 2.

Figure 4:
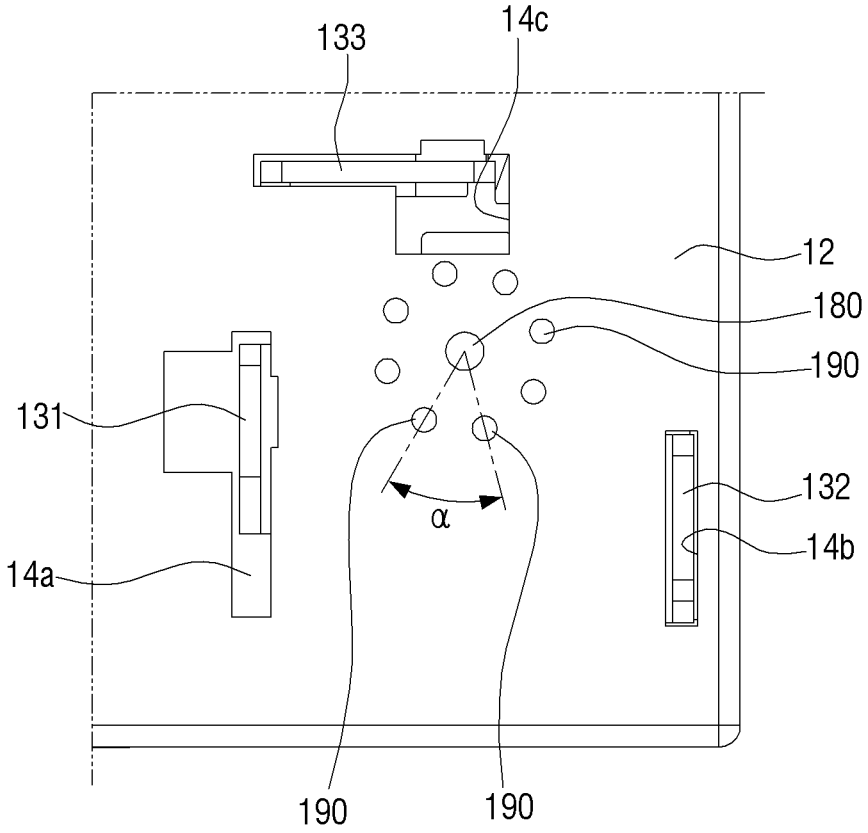
FIG. 4 is a view illustrating an arrangement of fixing projections that are formed on an upper surface of a main body as illustrated in FIG. 1 and a gap between the fixing projections.
Figure 5:
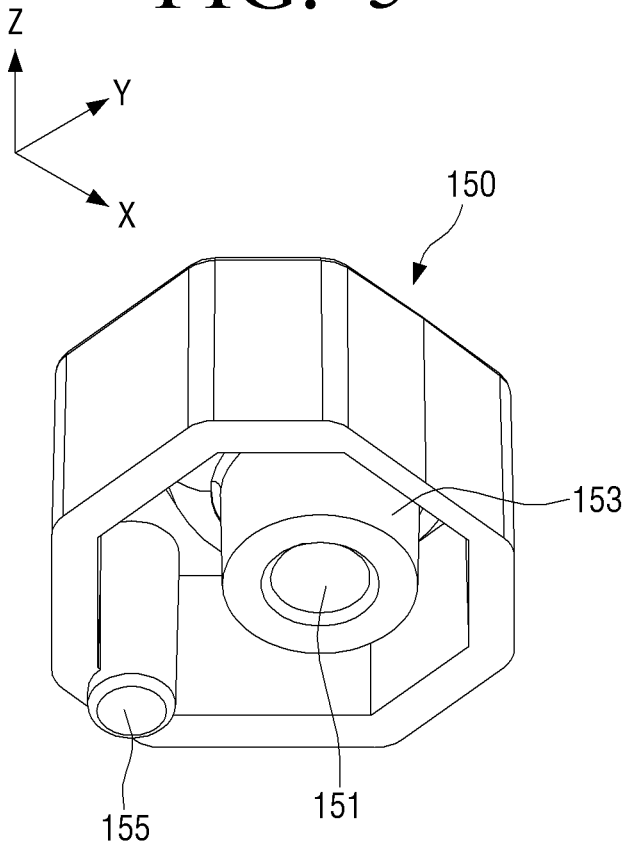
FIG. 5 is a perspective view of a cam member as illustrated in FIG. 1.

FIG. 4 is a view illustrating an arrangement of fixing projections that are formed on an upper surface of a main body as illustrated in FIG. 1 and a gap between the fixing projections, and FIG. 5 is a perspective view of a cam member as illustrated in FIG. 1.

Referring to FIGS. 4 and 5, the cam member 150 may be inserted into the insertion hole 115 of the connection member 110 in order to set the installation position of the connection member 110. The cam member 150 has a through-hole 151 that is formed thereon to penetrate in a Z-axis direction, and the through-hole 151 is formed to penetrate a boss 153 that is formed inside the cam member 150. The fastening member (e.g., fastening bolt or the like) 170 is penetratingly inserted into the through-hole 151. The fastening member 170 fixes the cam member 150 to the upper surface 12 of the main body 11 so that the cam member 150 maintains a set state of a predetermined posture. In this case, the fastening member 170 passes through the through-hole 151 of the cam member 150, and is separably fastened to a fastening hole 180 that is penetratingly formed on the upper surface 12 of the main body 11. The cam member 150 may have a setting projection 155 that is formed to project downward. The setting projection 155 is inserted into any one of a plurality of setting holes 190 that are arranged at equal intervals a (e.g., 45°) in a circumferential direction around the fastening hole 180. Eight setting holes 190 may be provided so that eight setting postures of the cam member 150 can be set. In this case, it is also possible that the number (n−1) of the setting holes 190 is set to be smaller than the number (n) of the side surfaces of the cam member 150 by 1. This is because the first and second side surfaces 156*a* and 156*b* among the plurality of side surfaces of the cam member 150 have distances D1 and D2 that are equal to each other (D1=D2) from the through-hole 151 of the cam member 150, and thus the installation position of the connection member 110 can be set through seven postures (initial position (0, 0), three positions in the direction of Y1, and three positions in the direction of Y2).

FIG. 6 is a schematic view illustrating a state where a cam member is inserted into an insertion groove of a connection member.

Referring to FIG. 6, the cam member 150 is in an octagonal shape, and thus includes eight side surfaces, that is, first to eighth side surfaces 156*a* to 156*h*. The first to eighth side surfaces 156*a* to 156*h* are arranged so that each pair of the opposite side surfaces corresponds to the first and second end portions 115*a* and 115*b* of the insertion hole 115 of the connection member 110. Specifically, the first and second side surfaces 156*a* and 156*b* are positioned at equal distances (D1=D2) from the center of the through-hole 151 and are arranged in parallel to each other. The third and fourth side surfaces 156*c* and 156*d* are positioned at different distances (D3<D4) from the center of the through-hole 151 and are arranged in parallel to each other. The fifth and sixth side surfaces 156*e* and 156*f* are positioned at different distances (D5<D6) from the center of the through-hole 151 and are arranged in parallel to each other. The seventh and eighth side surfaces 156*g* and 156*h* are positioned at different distances (D7<D8) from the center of the through hole 151 and are arranged in parallel to each other. The corresponding side surfaces of the first to eighth side surfaces 156*a* to 156*h* may have widths that are different from each other.

The first and second side surfaces 150*a* and 150*b* are positioned at equal distances (D1=D2) from the center of the through-hole 151, and are defined as initial positions. In order to make a user recognize such initial positions, a portion of the upper surface of the cam member 150, which is adjacent to the first side surface 156*a*, may include a indicating portion that is composed of characters (specifically, figures) of "0.0". Such a indicating portion may be provided on not only the portion that is adjacent to the first side surface 156*a* but also the portions that are adjacent to the third to eighth side surfaces 156*c* to 156*h*. The respective indicating portions may be composed of different figures corresponding to the distances between the side surfaces and the through-hole 151. In this case, the indicating portions may be formed on the upper surface of the cam member 150 using intaglio engraving or relief engraving. Further, the indicating portions are provided corresponding to set postures of the cam member 150. That is, seven indicating portions (0.0, +1.0, +2.0, +3.0, −1.0, −2.0, and −3.0) correspond to seven postures of the cam member 150.

FIG. 7 is a schematic view illustrating a state where the posture of a cam member is set so that a connection member moves in a direction of an arrow Y1.

Referring to FIG. 7, the third and fourth side surfaces 156*c* and 156*d* are positioned at different distances (D3<D4) from the center of the through-hole 151. The distance D3 may be set to be smaller than the distance D1 of the initial position by 1 mm, and the distance D4 may be set to be larger than the distance D1 of the initial position by 1 mm. In this case, characters of "−1.0" may be displayed on the portion of the upper surface of the cam member 150, which is adjacent to the third side surface 156*c*, and characters of "+1.0" may be displayed on the portion that is adjacent to the fourth side surface 156*d*.

FIG. 8 is a schematic view illustrating a state where the posture of a cam member is set so that a connection member moves in a direction of an arrow Y2.

Referring to FIG. 8, if the cam member 150 is inserted into the insertion hole 115 of the connection member 110 so that the third side surface 156*c* corresponds to the second end portion 115*b* of the insertion hole 115 and the fourth side surface 156*d* corresponds to the first end portion 115*a* of the insertion hole 115, the installation position of the connection member 110 moves from the initial position to a place that is 1 mm away from the initial position in the direction of Y1 (see FIG. 8). In this case, the gap between the main body 11 and the door is narrowed by 1 mm.

In the same manner as the third and fourth side surfaces 156*c* and 156*d*, the fifth and sixth side surfaces 156*e* and 156*f* and the seventh and eighth side surfaces 156*g* and 156*h* are respectively arranged to correspond to the first and second end portions 115*a* and 115*b* of the insertion hole 115 to vary the installation position of the connection member 110.

Specifically, the fifth and sixth side surfaces 156*e* and 156*f* are positioned at different distances (D5<D6) from the center of the through-hole 151. The distance D5 may be set to be smaller than the distance D1 of the initial position by 2 mm, and the distance D6 may be set to be larger than the distance D1 of the initial position by 2 mm. In this case, characters of "−2.0" may be displayed on the portion of the upper surface of the cam member 150, which is adjacent to the fifth side surface 156*e*, and characters of "+2.0" may be displayed on the portion that is adjacent to the sixth side surface 156*f*. If the cam member 150 is inserted into the insertion hole 115 of the connection member 110 so that the fifth side surface 156*e* corresponds to the first end portion 115*a* of the insertion hole 115 and the sixth side surface 156*f* corresponds to the second end portion 115*b* of the insertion hole 115, the installation position of the connection member 110 moves from the initial position to a place that is 2 mm away from the initial position in the direction of Y1. In this case, the gap between the main body 11 and the door is widened by 2 mm. In contrast, if the cam member 150 is inserted into the insertion hole 115 of the connection member 110 so that the fifth side surface 156*e* corresponds to the second end portion 115*b* of the insertion hole 115 and the sixth side surface 156*f* corresponds to the first end portion 115*a* of the insertion hole 115, the installation position of the connection member 110 moves from the initial position to a place that is 2 mm away from the initial position in the direction of Y2. In this case, the gap between the main body 150 and the door is narrowed by 2 mm.

The seventh and eighth side surfaces 156*g* and 156*h* are positioned at different distances (D7<D8) from the center of the through-hole 151. The distance D7 may be set to be smaller than the distance D1 of the initial position by 3 mm, and the distance D8 may be set to be larger than the distance D1 of the initial position by 3 mm. In this case, characters of "−3.0" may be displayed on the portion of the upper surface of the cam member 150, which is adjacent to the seventh side surface 156*g*, and characters of "+3.0" may be displayed on the portion that is adjacent to the eighth side surface 156*h*. If the cam member 150 is inserted into the insertion hole 115 of the connection member 110 so that the seventh side surface 156*g* corresponds to the first end portion 115*a* of the insertion hole 115 and the eighth side surface 156*h* corresponds to the second end portion 115*b* of the insertion hole 115, the installation position of the connection member 110 moves from the initial position to a place that is 3 mm away from the initial position in the direction of Y1. In this case, the gap between the main body 11 and the door is widened by 3 mm. In contrast, if the cam member 150 is inserted into the insertion hole 115 of the connection member 110 so that the seventh side surface 156*g* corresponds to the second end portion 115*b* of the insertion hole 115 and the eighth side surface 156*h* corresponds to the first end portion 115*a* of the insertion hole 115, the installation position of the connection member 110 moves from the initial position to a place that is 3 mm away from the initial position in the direction of Y2. In this case, the gap between the main body 150 and the door is narrowed by 3 mm.

As described above, the cam member 150 makes a pair of side surfaces that are positioned opposite to each other among the first to eighth side surfaces correspond to the first and second end portions 115*a* and 115*b* of the insertion hole 115, and thus the installation position of the connection member 110 can be selectively set.

In this embodiment, it is exemplified that the cam member 150 is in the shape of an octagon, but is not limited thereto. The cam member 150 may be in any shape of a rectangle, a hexagon, a decagon, and the like, which have even-numbered side surfaces. For example, if the cam member 150 is in the shape of a rectangle, four side surfaces that form two pairs of opposite side surfaces are provided, and thus one installation position in the direction of Y1 and one installation position in the direction of Y2 can be set from the initial installation position (position in which distances between the through-hole 151 and the respective side surfaces are equal to each other). If the cam member 150 is in the shape of a rectangle as described above, it is preferable that three setting holes are formed on the upper surface 12 of the main body 11 at total. In this case, if the setting projection 155 of the cam member 150 is inserted into one of the three setting holes, the cam member 150 is set to be in the first posture, and thus the installation position of the connection member 110 can be set to the initial position. If the setting projection 155 of the cam member 150 is inserted into another of the three setting holes, the cam member 150 is set to be in the second posture, and thus the installation position of the connection member 110 can be set to a position that is obtained by moving the installation position for a predetermined distance in the direction of Y1. If the setting projection 155 of the cam member 150 is inserted into the remaining one of the three setting holes, the cam member 150 is set to be in the third posture, and thus the installation position of the connection member 110 can be set to a position that is obtained by moving the installation position for a predetermined distance in the direction of Y2.

Figure 9:
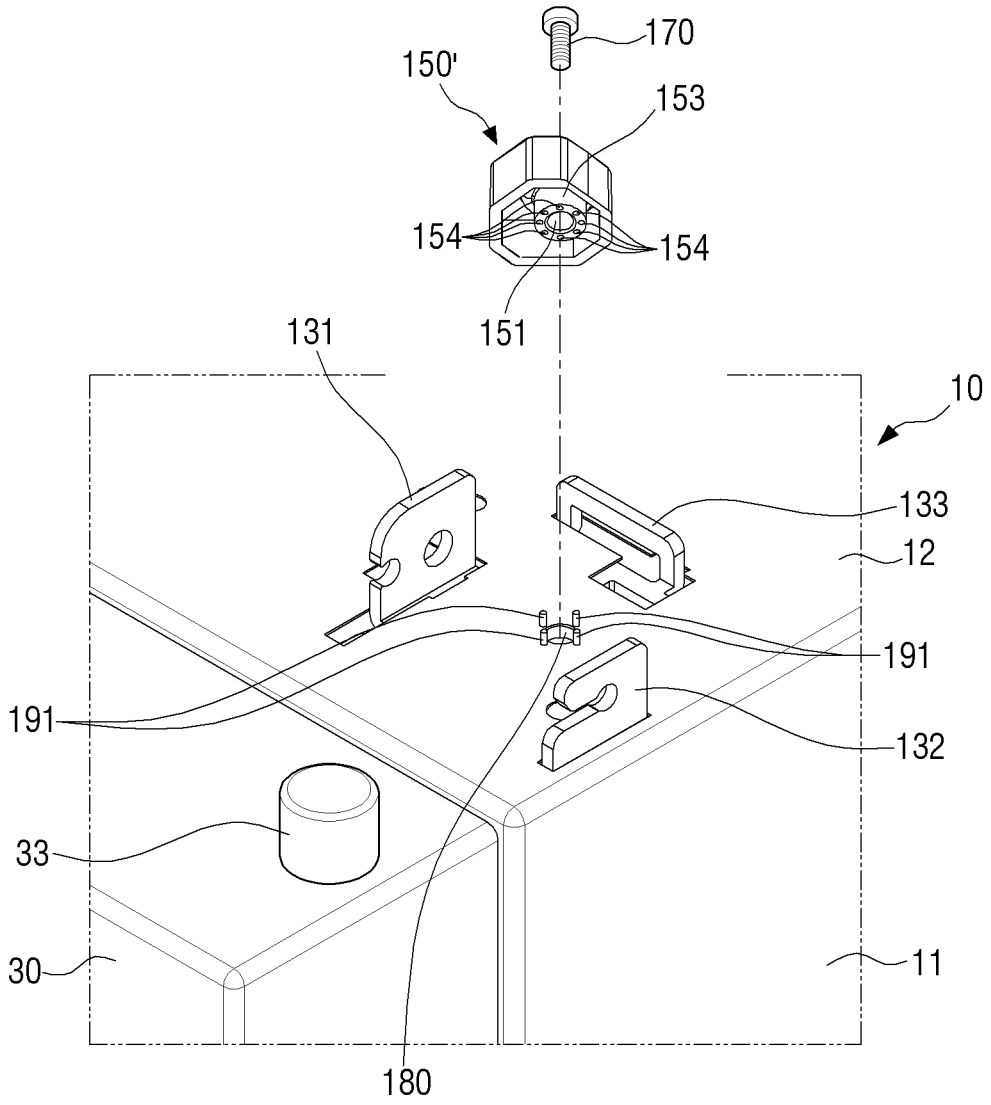
FIG. 9 is an exploded perspective view illustrating another example of a fixing means for maintaining a cam member in a set posture.

FIG. 9 is an exploded perspective view illustrating another example of a fixing means for maintaining a cam member in a set posture.

Referring to FIG. 9, a cam member 150' may have a plurality of setting holes 154 formed thereon at equal intervals along a lower end of a boss 153, and a plurality of setting projections 191 that are coupled to the plurality of setting holes 154 formed on the cam member 150' may be formed on the upper surface 12 of the main body 11. The plurality of setting holes 154 of the cam member 150' and the plurality of setting projections 191 on the upper surface 12 of the main body 11 may perform the same functions as the functions of the setting projections 155 of the cam member 150 and the plurality of setting holes 190 formed on the upper surface of the main body 11 as described above.

Figure 10:
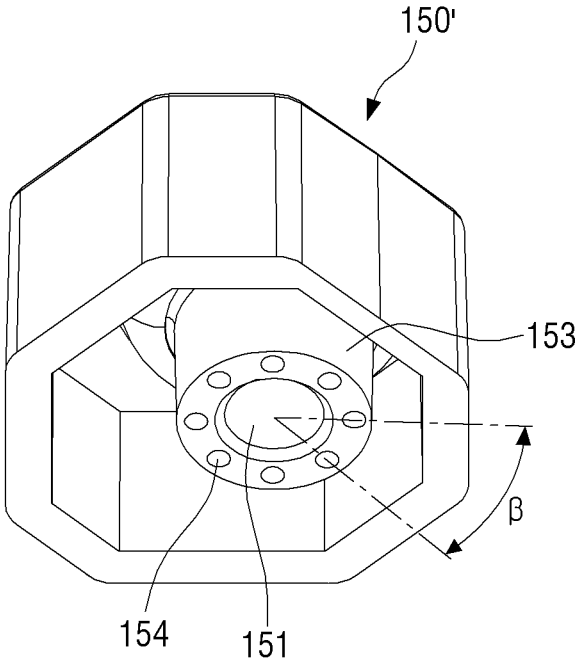
FIG. 10 is a perspective view of a cam member as illustrated in FIG. 9.

FIG. 10 is a perspective view of a cam member as illustrated in FIG. 9.

Referring to FIG. 10, eight setting holes 154 of the cam member 150' may be arranged at the same angle β (e.g., 45°) along the circumferential direction based on the center of the through-hole 151. In this case, it is illustrated that four setting projections 191 are formed on the upper surface 12 of the main body 11 for a predetermined fixing force, but the number of setting projections is not limited thereto. At least one setting projection 191 may be provided.

As described above, the hinge supporting apparatus 100 for a refrigerator door according to an embodiment of the present disclosure has a structure in which the fixing member 130 fixes the connection member 110 to the main body 11 through the clamping operation using the bracket 130*a* and the pressing lever 135. However, the fixing member 130 is not limited to the above-described structure, but may be composed of a plurality of fastening screws. This will be described in detail hereinafter.

Figure 11:
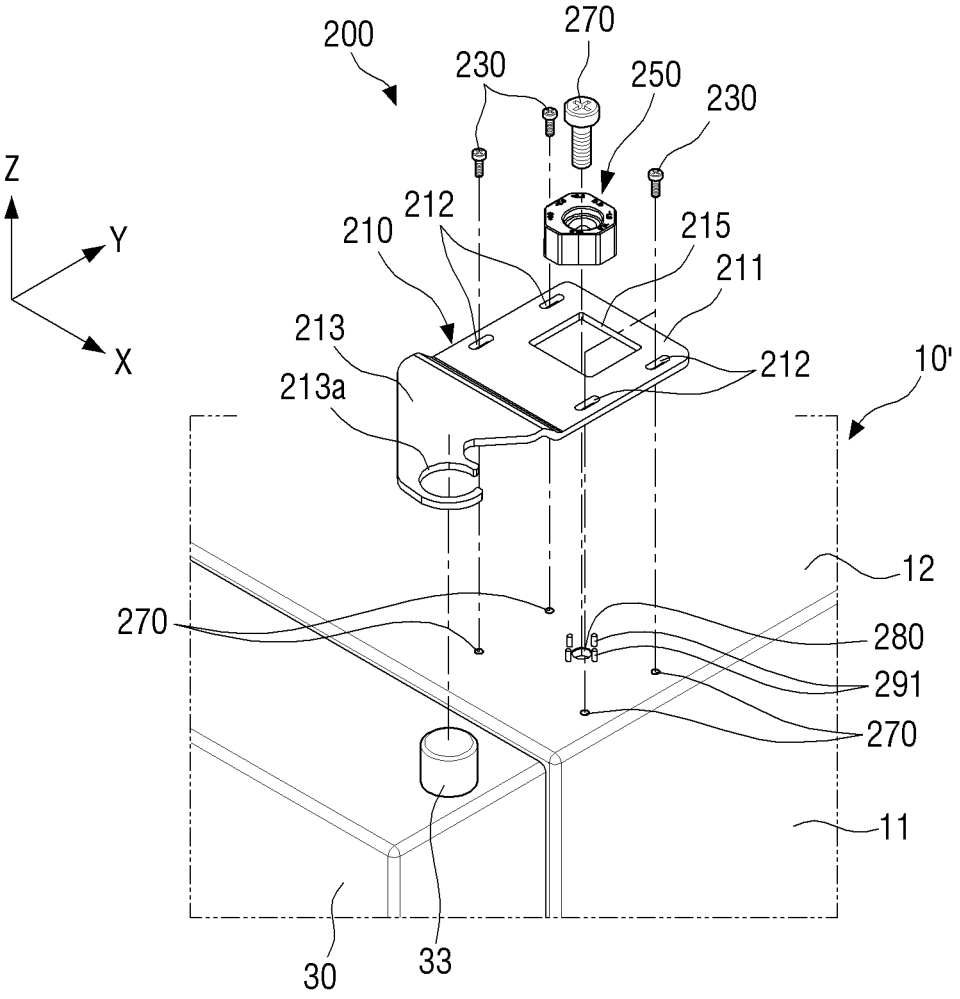
FIG. 11 is an exploded perspective view illustrating a hinge supporting apparatus for a refrigerator door according to another embodiment of the present disclosure.

FIG. 11 is an exploded perspective view illustrating a hinge supporting apparatus for a refrigerator door according to another embodiment of the present disclosure.

Referring to FIG. 11, a hinge supporting apparatus 200 for a refrigerator door according to another embodiment of the present disclosure may include a connection member 210, a fixing member 230, a cam member 250, and a fastening member 270.

A part of the connection member 210 and the fixing member 230 have different structures from those of the hinge supporting apparatus 100 for a refrigerator door according to an embodiment of the present disclosure, and the cam member 250 and the fastening member 270 have the same structures as those of the cam member 150 and the fastening member 170 of the hinge supporting apparatus 100 for a refrigerator door according to an embodiment of the present disclosure as described above. Accordingly, only the part of the connection member 210 and the fixing member 230, which have the different structures from those of the hinge supporting apparatus 100 for a refrigerator door according to an embodiment of the present disclosure as described above, will be described hereinafter.

The fixing member 230 is composed of a plurality of fastening screws which are fastened to the upper surface 12 of the main body 11 through penetration of four points of one side portion 211 of the connection member 230. In this case, a plurality of long holes 212, which are formed with a predetermined length in the Y-axis direction, are formed on the one side portion 211 of the connection member 230 that are penetrated by the plurality of fastening screws. In this case, a plurality of fastening holes 270, to which the fixing member 230 is fastened, are formed on the upper surface 12 of the main body 11.

The length of the plurality of long holes 212 will suffice unless they interfere with the movement of the connection member 210 in a state where the fixing member 230 is fastened to the plurality of long holes 212 when the installation position of the connection member 210 is varied in accordance with the setting of the cam member 250.

As s structure for maintaining the set state of the cam member 250, a plurality of setting projections 291 that are formed to project from the upper surface 12 of the main body 11 and a plurality of setting holes (see FIG. 10) that are formed on the cam member 250 may be provided.

In FIG. 11, an unexplained reference numeral 10' denotes a refrigerator, 30 denotes a door, 33 denotes a hinge shaft, 213 denotes the other side portion of the connection member 210, 213*a* denotes a hinge groove, 215 denotes an insertion hole, and 280 denotes a fastening hole.

The foregoing exemplary embodiments and advantages are merely exemplary and are not to be construed as limiting the present disclosure. The present teaching can be readily applied to other types of apparatuses. Also, the description of the exemplary embodiments of the present disclosure is intended to be illustrative, and not to limit the scope of the claims, and many alternatives, modifications, and variations will be apparent to those skilled in the art.

What is claimed is:

1. A hinge supporting apparatus comprising:

a connection member configured to hinge-connect a door to a main body;

a cam member configured to vary an installation position of the connection member in order to control a gap between the main body and the door; and a fixing member configured to fix the connection member to the main body, wherein the connection member has an insertion hole which is formed thereon and into which the cam member is inserted, wherein the insertion hole includes a first end portion that corresponds to one flat side surface of the cam member and a second end portion which corresponds to another flat side surface of the cam member that forms a pair with the one flat side surface of the cam member, and wherein the first and second end portions are spaced apart from each other in a direction in which the door moves away from or approaches the main body, and form a gap that is equal to a gap between the one flat side surface and the other flat side surface of the cam member, so that the one flat side surface and the other flat side surface of the cam member are in contact with the first and second end portions, respectively, when the cam member is inserted into the insertion hole.

2. The hinge supporting apparatus as claimed in claim 1, wherein the first and second end portions are arranged in parallel.

3. The hinge supporting apparatus as claimed in claim 2, wherein the cam member comprises at least two pairs of flat side surfaces that form pairs, and the flat side surfaces of any one of the at least two pairs of flat side surfaces are arranged at equal distances from one portion of the cam member, and the flat side surfaces of the other of the at least two pairs of flat side surfaces are arranged at different distances from the one portion of the cam member.

4. The hinge supporting apparatus as claimed in claim 3, wherein a fastening member is penetratingly coupled to the one portion of the cam member, and fixes the cam member to the main body.

5. The hinge supporting apparatus as claimed in claim 4, wherein the main body has a fastening hole which is formed thereon and to which the fastening member is fastened, and a plurality of setting holes which are formed thereon in a circumferential direction around the fastening hole, and the cam member includes a setting projection that is inserted into at least one of the plurality of setting holes.

6. The hinge supporting apparatus as claimed in claim 5, wherein the number of the plurality of setting holes is equal to or smaller than the number of flat side surfaces of the cam member by one.

7. The hinge supporting apparatus as claimed in claim 4, wherein the main body has a fastening hole which is formed thereon and to which the fastening member is fastened, and at least one setting projection that is adjacent to the fastening hole, and the cam member includes a plurality of setting holes into which the at least one setting projection is inserted.

8. The hinge supporting apparatus as claimed in claim 3, wherein the cam member comprises a plurality of indicating portions that correspond to postures of the cam member.

9. The hinge supporting apparatus as claimed in claim 8, wherein the plurality of indicating portions are formed in positions that correspond to the respective flat side surfaces of the cam member on the cam member.

10. The hinge supporting apparatus as claimed in claim 1, wherein the fixing member comprises: a bracket that is fixed to the main body; and a pressing lever having one side that is rotatably connected to the bracket so as to clamp the connection member on the main body or to release clamping.

11. The hinge supporting apparatus as claimed in claim 1, wherein the fixing member comprises a plurality of fastening screws configured to separably fasten the connection member to the main body.

12. A hinge supporting apparatus comprising:

a connection member having one side portion that is variably fixed to a main body of a refrigerator and the other side portion that is hinge-connected to a door of the refrigerator; and a cam member configured to be inserted into the one side portion of the connection member to control a gap between the main body and the door in accordance with variation of an installation position of the connection member, wherein the cam member has a plurality of flat side surfaces which are even-numbered to form pairs with the flat side surfaces that are arranged in opposite directions to each other, wherein the connection member has an insertion hole which is formed on the one side portion of the connection member and into which the cam member is inserted, wherein the insertion hole includes first and second end portions that correspond to the flat side surfaces of one of the pairs of flat side surfaces of the cam member, and wherein the first and second end portions of the insertion hole are spaced apart from each other in a direction in which the door moves away from or approaches the main body, and form a gap that is equal to a gap between the flat side surfaces of the one of the pairs of flat side surfaces of the cam member, so that the flat side surfaces of the one air of flat side surfaces of the cam member are in contact with the first and second end portions when the cam member is inserted into the insertion hole.

13. The hinge supporting apparatus as claimed in claim 12, wherein the flat side surfaces that form the pairs of the cam member are arranged in parallel.

14. The hinge supporting apparatus as claimed in claim 12, wherein the cam member has a through-hole to which a fastening member that is separably fixed to the main body is penetratingly coupled, and any one of the flat side surfaces that form the pairs of the cam member is arranged at equal distances from the through-hole, and the flat side surfaces that form the remaining pairs are arranged at different distances from the through-hole.

15. The hinge supporting apparatus as claimed in claim 14, wherein the cam member further includes: at least one setting projection for maintaining the cam member in any one of predetermined postures; and a plurality of setting holes into which the at least one setting projection is inserted.

16. The hinge supporting apparatus as claimed in claim 15, wherein the setting projection is formed on any one of the cam member and the main body, and the plurality of setting holes are formed on the remaining one of the cam member and the main body.

17. The hinge supporting apparatus as claimed in claim 12, further comprising a fixing member configured to fix the connection member to the main body in order to maintain an installation position of the connection member.

* * * * *